US005889451A

United States Patent [19]

Kern

[11] Patent Number: 5,889,451

[45] Date of Patent: Mar. 30, 1999

[54] ELECTROMAGNETIC RELAY AND ITS USE ON A PRINTED CIRCUIT BOARD

[75] Inventor: Josef Kern, Berlin, Germany

[73] Assignee: Siemens Aktiengesellschaft, Munich, Germany

[21] Appl. No.: 11,406

[22] PCT Filed: Jul. 8, 1996

[86] PCT No.: PCT/DE96/01232

§ 371 Date: Jan. 27, 1998

§ 102(e) Date: Jan. 27, 1998

[87] PCT Pub. No.: WO97/08724

PCT Pub. Date: Mar. 6, 1997

[30] Foreign Application Priority Data

Aug. 23, 1995 [DE] Germany ..... 195 31 045

[51] Int. Cl.[6] ..... H01H 51/22; H01H 67/02

[52] U.S. Cl. ..... 335/78; 335/83; 335/128; 335/202

[58] Field of Search ..... 335/78–86, 128, 335/202, 267, 268

[56] References Cited

U.S. PATENT DOCUMENTS

| | | | |
|---|---|---|---|
| 4,745,382 | 5/1988 | Dittmann | 335/128 |
| 5,534,834 | 7/1996 | Hendel | 335/78 |

FOREIGN PATENT DOCUMENTS

| | | |
|---|---|---|
| 511 845 | 1/1954 | Belgium . |
| 2 412 934 | 7/1979 | France . |
| 2 250 909 | 10/1973 | Germany . |
| 25 29 205 | 1/1977 | Germany . |
| 28 54 591 | 6/1979 | Germany . |
| 42 43 852 | 3/1994 | Germany . |

*Primary Examiner*—Michael L. Gellner
*Assistant Examiner*—Raymond Barrera
*Attorney, Agent, or Firm*—Hill & Simpson

[57] ABSTRACT

The relay has at least one switching system with a base body (1) forming a baseplate (11), in which base body a contact spring connection element (4) and mating contact elements (5, 6) are anchored and on which base body a coil (21, 22) with a core (23) and a yoke (24) is arranged upright with the coil axis perpendicular to the baseplate, an armature being arranged between the coil and the baseplate. A contact spring (3) connected to the armature (26) is constructed in a U-shaped manner, and the resultant two spring limbs form a connection limb (31) and a contact limb (32) having high current conductivity. The relay can be produced in a simple manner with simple parts either as a single relay or as a double or multiple relay.

13 Claims, 7 Drawing Sheets

X-X

ELECTROMAGNETIC RELAY AND ITS USE ON A PRINTED CIRCUIT BOARD

BACKGROUND OF THE INVENTION

The invention relates to an electromagnetic relay having at least one switching system, which has:

a base body forming a baseplate, a contact spring connection element and at least one mating contact element, which are each anchored in the base body, a coil with a core and a yoke, which coil is arranged upright with its winding axis vertically over the baseplate, an armature arranged between the coil and the baseplate, and a contact spring, which is connected to the armature and interacts with the mating contact element.

In addition, the invention relates to the use of such a relay on a printed circuit board.

A relay of the type mentioned in the introduction is disclosed in German reference DE 28 54 591 A1, for example. In that case, the contact spring is fastened as an armature restoring spring to the yoke, and the associated connection element is connected to the yoke on the opposite side. Apart from the manufacturing difficulties entailed by such fastening of the current-carrying parts on two opposite sides of the yoke, the current path from the contact spring to the printed circuit board thereby becomes comparatively long. Moreover, the two-fold contact resistance could lead to undesirable heating in the event of high switching currents.

German reference DE 42 43 852 C1 likewise shows a relay of the type mentioned in the introduction. In that case, in order to obtain a sufficient spring length at the rear side of the yoke the contact spring is first of all angled upward, is then bent downward through 180° and fitted, using a connecting element in the form of a resilient clamping device, onto the associated connection element, where it is then permanently welded in a further work operation.

SUMMARY OF THE INVENTION

The aim of the present invention is to configure an electromagnetic relay of the type mentioned in the introduction in such a way that it can switch high currents with good utilization of space, can be produced cost-effectively with a small number of simple parts and can be manufactured with largely identical individual parts either as a single relay or as a double or multiple relay.

According to the invention, this aim is achieved in that the contact spring forms two spring limbs, which are connected to one another in a U-shaped manner in the region of the armature bearing and whose ends lie approximately next to one another in the vicinity of the movable armature end, in that a first spring limb is connected as restoring limb to the contact spring connection element, and in that the second spring limb is connected as contact limb to the armature and interacts at its free end with the mating contact element for the purpose of contact-making.

By way of the two spring limbs being coherent in the shape of a U, the contact spring provided according to the invention acquires a sufficient spring length with a relatively large spring width for carrying even relatively high switching currents. Since the spring lies underneath the armature directly over the baseplate and is connected there, via its restoring limb, directly to the connection element, it is also possible to keep the current path short and ensure a small contact resistance. In order to obtain a large spring cross section, it is expedient that the contact spring, with its two spring limbs, covers approximately the entire area underneath the armature, the ends of the spring limbs projecting over the movable armature end, and the contact spring connection element as well as the at least one mating contact element being and in the base body in the region in front of the movable armature end and being mutually oppositely angled in the direction of the free ends of the spring limbs. The U-shape of the contact spring can be obtained, for example, by cutting the two spring limbs out of an essentially planar spring metal-sheet and, if appropriate, providing them only with prestressing bends. In another, likewise advantageous embodiment, the two spring limbs are obtained by folding the contact springs in a U-shaped manner through 180°, the ends of the spring limbs being mutually oppositely cut free as far as toward approximately half of the total spring width; in this way, the relevant end sections can be pivoted toward one another without butting against one another, while the total spring width is available for carrying current in the region of the U-shaped bend.

Since the contact-making sections of the contact spring and of the mating contact element and also the contact spring connection element project over the region of the base area of the coil in order to enable a large spring length, on the one hand, and, on the other hand, easily producible magnetic circuit parts with large pole faces, a free space which can be utilized in some other way is produced over these contact-making sections and in front of the coil. If an approximately parallelepipedal cap is slipped onto the relay, this free space inside the cap can be utilized for accommodating additional components, for instance resistors or diodes or else a control module. If, on the other hand, use is made of a cap which is recessed in the direction of the coil above the contact-making sections, then the free space, which lies outside the housing in this case, can likewise be used for the arrangement of other components whose connecting wires are then made contact with next to the relay in the printed circuit board.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENT

Figure 1:
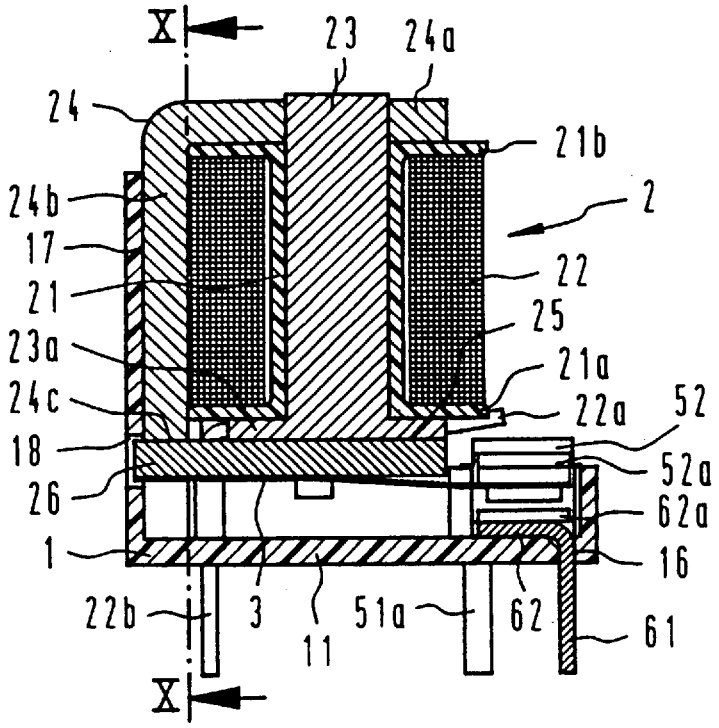
FIGS. 1 and 2 show a single relay configured according to the invention and without a cap, in section and in a perspective view.

The relay shown in FIGS. 1 to 5 has a base body 1 with a generally L-shaped configuration, namely with an essentially horizontal baseplate 11 and a retention part 12 which is vertical with respect thereto. (The terms "horizontal" and "vertical" refer throughout the description to a horizontal fitted position of the relay, the baseplate therefore being seated in a parallel manner on a horizontal printed circuit board.) The baseplate 11 has peripheral side walls 11*a*, 11*b* and 11*c*; at the end remote from the retention part 12, the side walls 11*a* and 11*b*, with inwardly projecting ribs and grooves, form mutually opposite insertion shafts 13 for receiving the contact elements, which will be described later.

The vertical retention part 12 has a generally U-shaped cross-section with side walls 12*a* and 12*b* and a rear wall 12*c*. The side walls 12*a* and 12*b*, together with inwardly projecting ribs 12*d*, form a drawer-shaped guiding shaft 17. Windows 14 are in each case cut out in the region of the guiding shaft; their function will be explained later. In addition, the rear wall 12*c* has a window 18, which ensures the freedom of movement of the armature (likewise described later).

A magnetic system 2 with a coil former 21, a winding 22, which is arranged on the coil former between the flanges 21*a* and 21*b* thereof, a core 23 arranged axially in the coil, and a yoke 24 angled in an L-shaped manner is fastened in the base body. Wind-on pins 22*a* with downwardly bent-away coil connection pins 22*b* are anchored in the region of the lower coil flange 21*a*. At its lower end, the round core 23 has a cross-sectionally enlarged pole plate 23*a*, which has a pole face 25. The yoke 24 is fastened by its first limb 24*a* to the upper end of the core 23, for example by slotting, welding or the like. The vertical limb 24*b* of the yoke is inserted into the guiding shaft 17 of the base body and fastened there. The lower terminating edge 24*c* of the yoke limb 24*b* forms a support for an armature 26, which forms an operating air gap with the pole face 25.

A contact spring 3 is fastened on the underside of the armature, which contact spring is cut essentially in a U-shaped manner (see FIG. 4) from a spring metal-sheet and thus forms two spring limbs, namely a restoring limb 31 and a contact limb 32. The two spring limbs lie approximately in one plane, but can be moved relative to one another at their ends and are, if need be, bent slightly out of their common sheet-metal plane with prestressing bends. The restoring limb is fastened by its end 31*a* to a contact spring connection element 4, which is bent in an L-shaped manner and is anchored with its vertical section 41 in an insertion shaft 13 of the base body. This vertical section 41 also carries a connection pin 41*a*, while a horizontal section 42 carries the contact spring 3.

The contact limb 32 is fastened by means of a rivet 33 or in another way to a central section of the armature. The movable end 32*a* of the contact limb carries opposite contact pieces 32*b*, which interact with corresponding mating contact elements. A make-contact mating contact element 5 is bent in an L-shaped manner; a vertical section 51 is in turn anchored in an insertion shaft 13 of the base body; it also forms a connection pin 51*a*. A horizontal section 52 of the make-contact mating contact element carries a contact piece 52*a*.

A break-contact mating contact element 6, which is likewise bent away in an L-shaped manner, is anchored by a vertical section 61 in a perforation 16 of the baseplate 11, while a horizontal section 62, which carries a contact piece 62*a*, bears on the baseplate 11 and thereby insures the robustness of this mating contact element.

Figure 6:
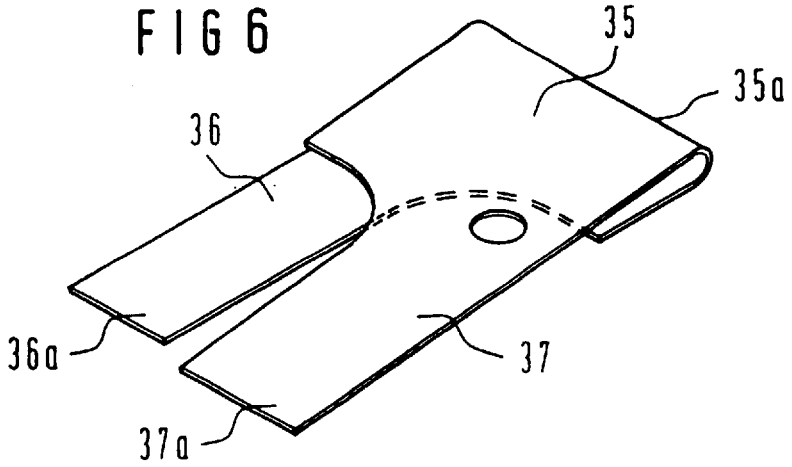
FIG. 6 shows a modified contact spring in a perspective view.
Figure 7:
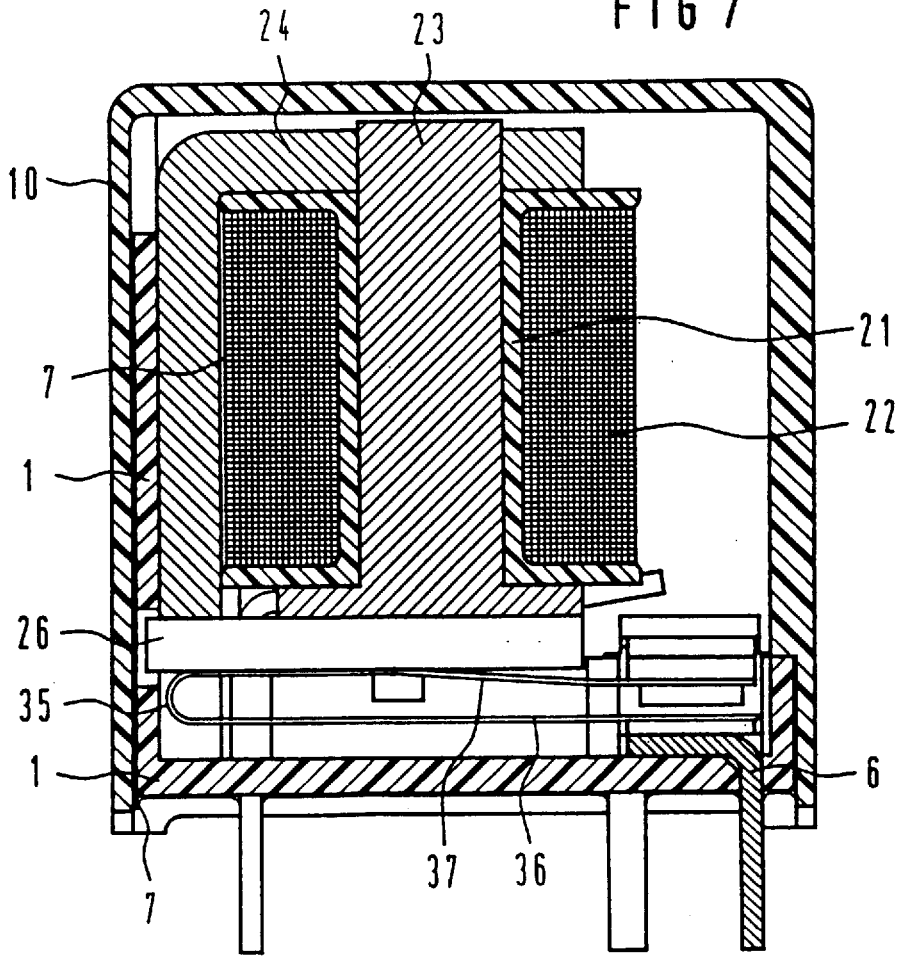
FIG. 7 shows a modified single relay with a contact spring according to FIG. 6 in a lateral sectional view.

FIG. 6 shows a modified contact spring 35, whose spring limbs 36 and 37 are not cut out of one plane, rather are obtained by folding the leaf spring through 180°, to be precise about an axis parallel to the armature bearing axis. The two spring limbs, namely the restoring limb 36 and the contact limb 37, are each cut free diagonally in opposite directions toward their free ends, with the result that they can lie next to one another in one plane in these end sections 36*a* and 37*a* and can be moved relative to one another. In the region of the bend 35*a*, on the other hand, the entire width of the contact spring, which essentially corresponds to the armature width, is available to both spring limbs. As a result it is possible to carry even higher load currents than in the embodiment according to FIGS. 3 and 4. The contact spring 35 is, moreover, fastened together with its spring limbs and provided with contact pieces in the same way as the contact spring 3 shown in FIG. 4. Its arrangement in a relay is shown in FIG. 7. The relay otherwise has exactly the same structure as the relay shown in FIG. 1. In contrast to FIG. 1, FIG. 7 additionally illustrates a housing cap 10, which is slipped over the magnetic system and connected to the base body 1. The gaps remaining between the base body 1 and the housing cap 10 are filled and sealed with potting compound 7.

Figure 2:
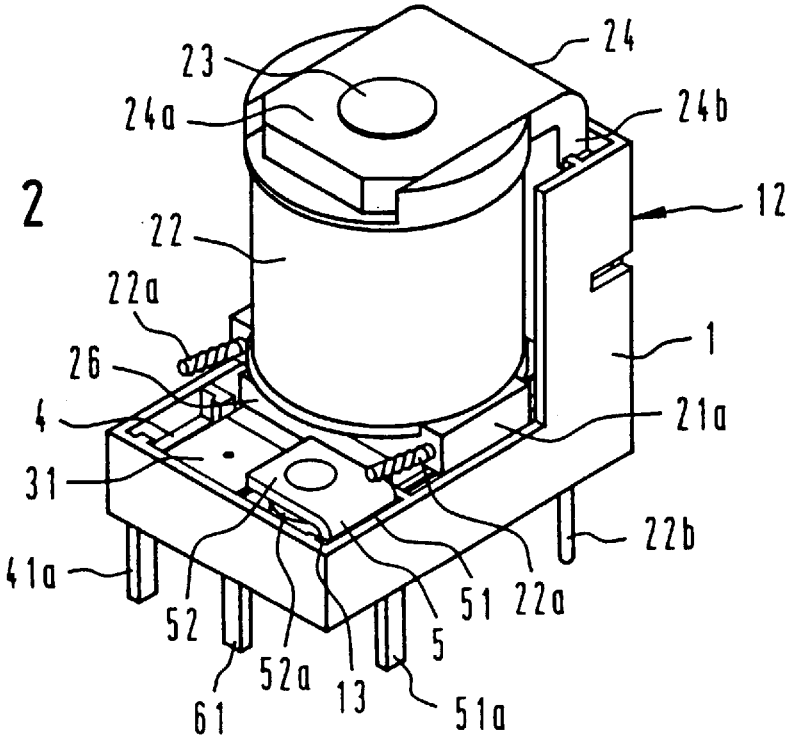
Figure 3:
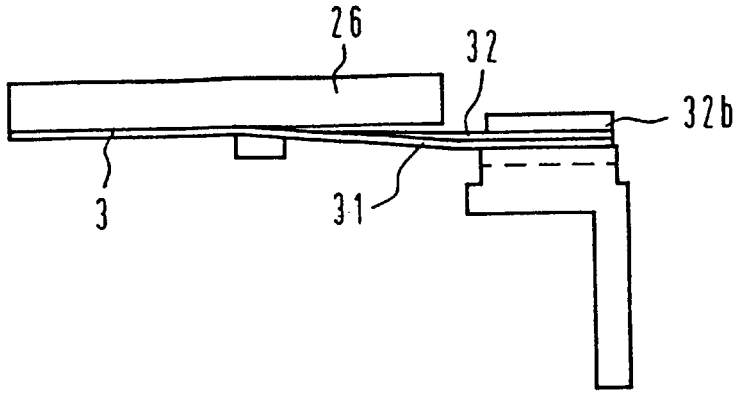
FIGS. 3 and 4 show an armature-contact spring assembly of the relay of FIG. 2, in a side view and in a perspective illustration.
Figure 4:
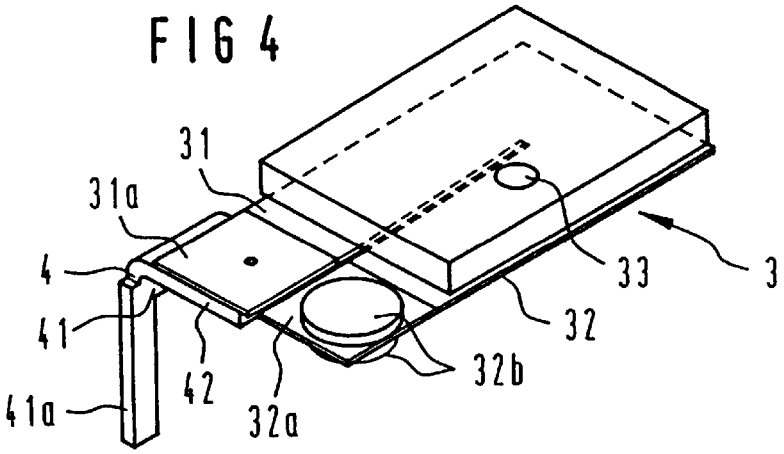
Figure 8:
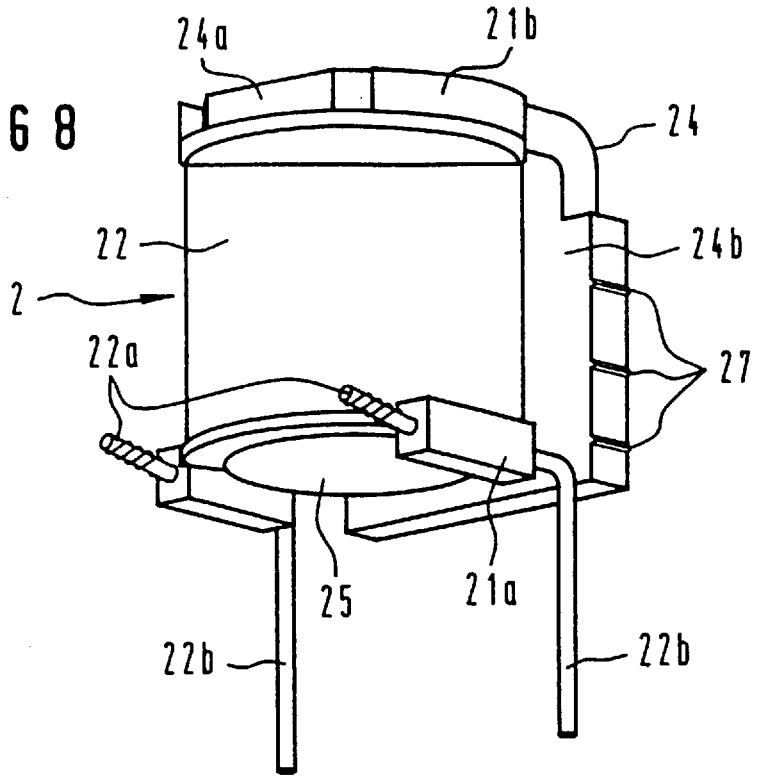
FIG. 8 shows a magnetic system for a relay according to FIG. 1 or 2 in a perspective illustration.
Figure 9:
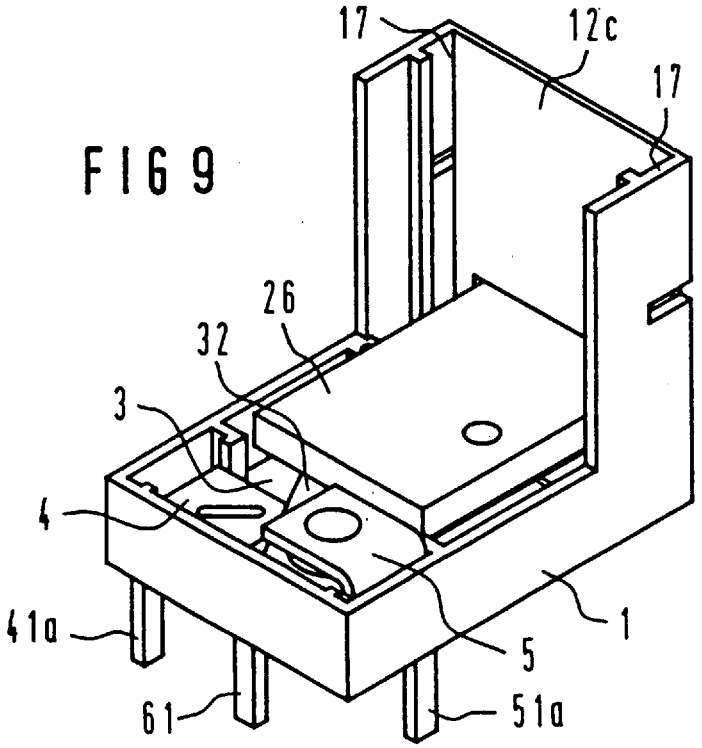
FIG. 9 shows a base body of a relay according to FIG. 1 or 2, an armature-contact spring assembly having been mounted on said base body.
Figure 10:
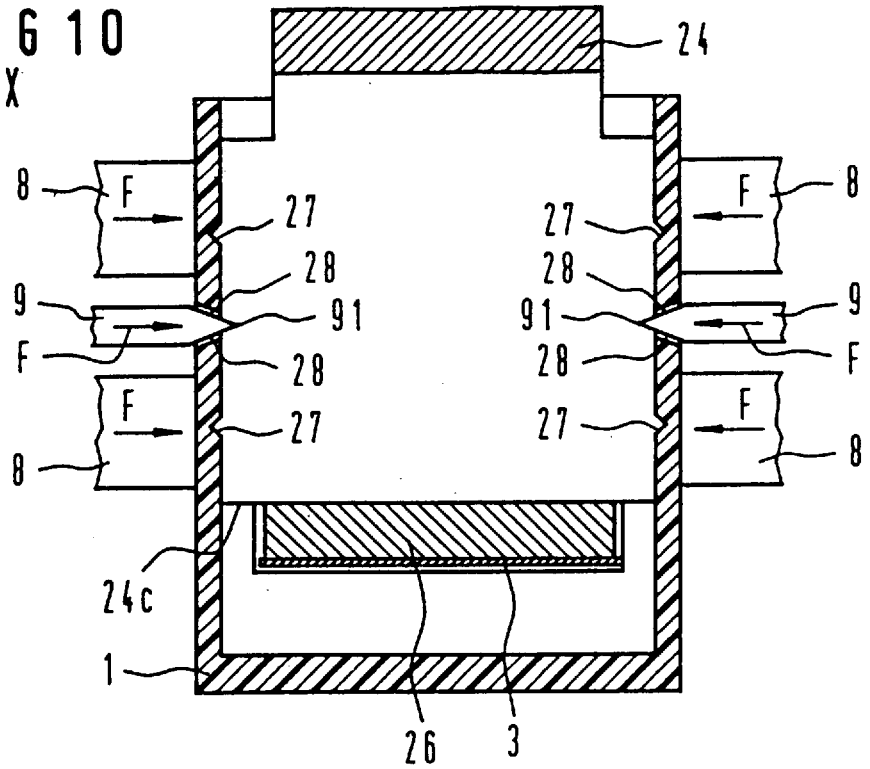
FIG. 10 shows an illustration of the yoke fastening in a relay according to FIG. 1 or 2.

The mounting of the magnetic system with simultaneous adjustment will now be described with reference to FIGS. 8 to 10. The magnetic system 2 illustrated in FIG. 8, which corresponds to that of FIG. 2, is pressed into the base body 1 which, in accordance with FIG. 9, has already been provided with the armature 26, the contact spring 3 including the connection element 4 as well as the mating contact elements 5 and 6. The width of the yoke limb 24*b* in this case corresponds exactly to the clear width in the guiding shaft 17. However, teeth 27 are additionally integrally formed on the outer edges of the yoke limb 24*b*, which teeth project beyond the width of the insertion shaft 13. When the yoke limb 24*b* is pressed into the guiding shaft 17, the side walls 12*a* and 12*b* are therefore expanded by the teeth 27. The yoke is in this case pushed into the guiding shaft 17 until the lower yoke edge 24*c* bears on the armature and the armature has a predetermined excess stroke when the contact piece 32*b* bears on the make-contact contact piece 52*a*. This excess stroke can be measured for example by pressing a probe on to the armature through a hole (not illustrated) in the baseplate and by measuring the travel of the armature from the first closing of the contact of the make contact until the final bearing of the armature on the pole face 25.

When the yoke limb 24*b* and thus the magnetic system 2 has reached the desired position, the yoke limb 24*b* is fastened in the guiding shaft 17. This is done in accordance with the illustration in FIG. 10 by punches 8 acting with a pressure force F in opposite directions on the two side walls 12*a* and 12*b* which have been expanded by the excess dimension of the teeth 27. As a result, the teeth 27 are forced into the plastic of the base body, where they effect a permanent cold deformation. As a result of this, the tensile stresses are relieved, and the two parts, namely the yoke limb 24*b* and the retention part 12 of the base body, are connected to one another in a positively locking manner.

For additional securing, notching punches 9, which are preferably fixedly connected to the punches 8, can be forced through the side walls 12*a* and 12*b*, in the region of the windows 14 and 15, on to the side edges of the yoke limb 24*b*, with the result that the notching cutters 91 dig into the material of the yoke. The resultant materials 28 displaced by notching on the side edges of the yoke limb 24*b* additionally ensure a tight fit of the magnetic system in the desired position.

As has already been mentioned above, in a preferred design of the relay, the underside of the baseplate 11 is sealed with a potting compound 7. This potting compound also penetrates into the edge gap between the base body 1 and the cap 10 (see FIG. 7). As is also shown in FIG. 7, the potting compound 7 can also flow, due to a capillary effect, into the guiding shaft 17 of the retention part 12 and additionally bond the yoke limb 24*b*.

Figure 11:
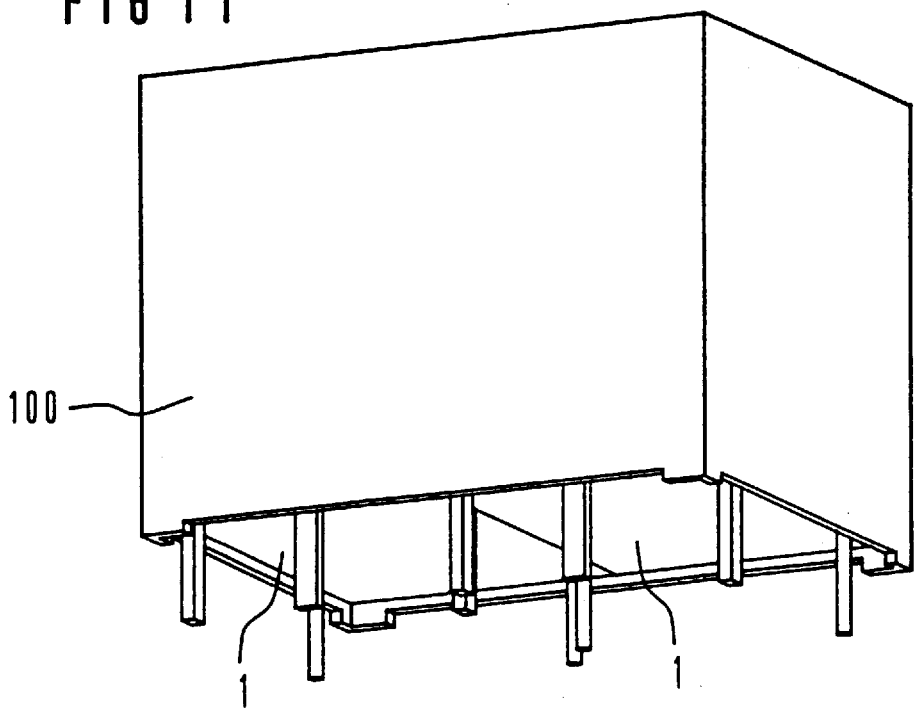
FIG. 11 shows a double relay having two relay switching systems according to FIG. 1 or 7.
Figure 12:
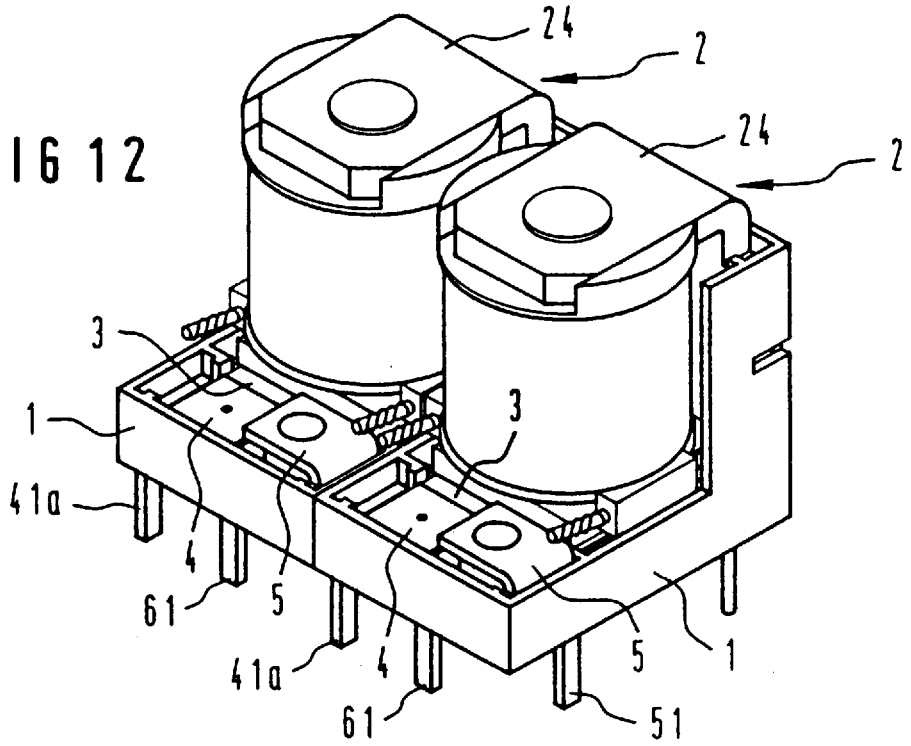
FIG. 12 shows the arrangement of the two switching systems for the relay according to FIG. 11 without a cap, in a perspective view.

FIG. 11 shows a double relay, to switching systems according to FIGS. 1 and 2 or according to FIG. 7 being accommodated in one cap 100. In this case, two base bodies 1 with magnetic systems correspondingly constructed on them are assembled independently of one another and then accommodated next to one another in the cap 100. The two systems without a cap are shown in FIG. 12. In this case, the two yokes 24 are adjusted independently of one another in the respectively associated base body 1 and fixed by pressing together the side walls 12*a* and 12*b* in accordance with FIG. 10. After the two systems have been inserted into the cap 100, the common underside of the two base bodies 1 can, for the purpose of sealing, be potted or be bonded in the cap.

Figure 5:
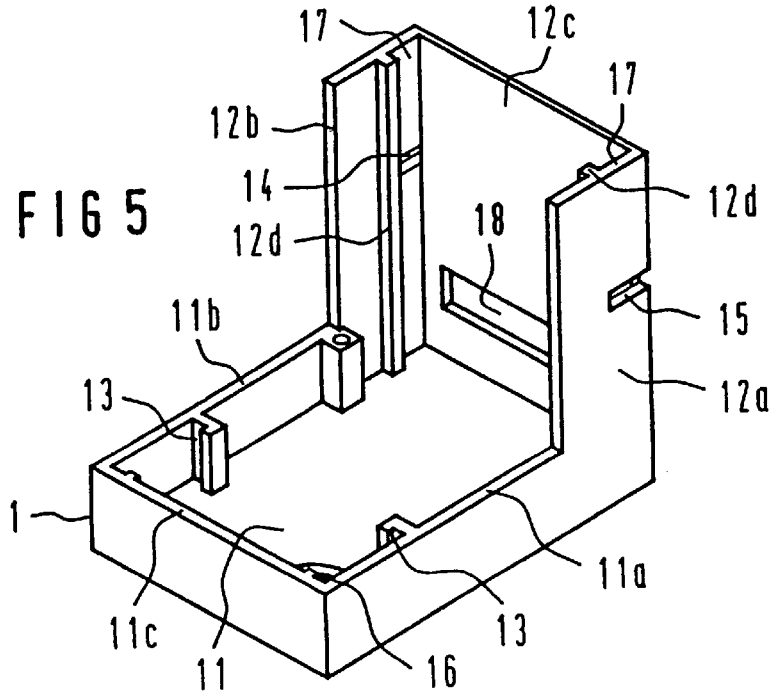
FIG. 5 shows the base body of the relay of FIG. 2 in a perspective illustration.
Figure 13:
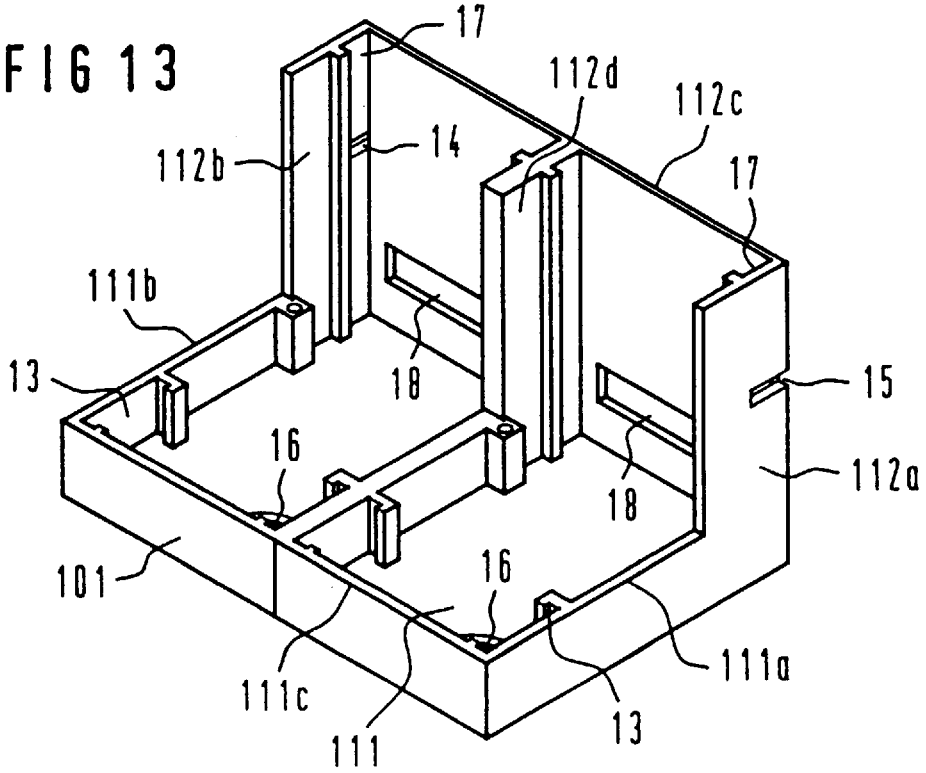
FIG. 13 shows a double base body for accommodating two switching systems.

However, an advantageous development provides for a common base body 101 in accordance with FIG. 13, which base body, with a baseplate 111 and with the side walls 111*a*, 111*b* and 111*c* and also with a partition wall 111*d*, forms a base part having two trough-shaped depressions. Insertion shafts 13 like those in the individual base body 1 according to FIG. 5 are provided here. In addition, a double retention part 112, with side walls 112*a* and 112*b*, a common rear wall 112*c* and a partition wall 112*d*, is constructed as a double embodiment of the previously mentioned individual base body 1. Accordingly, this double base body 101 also has two parallel guiding shafts 17 for the two yokes 24. The two yoke limbs 24*b* are mounted in the guiding shafts 17 in a manner analogous to FIG. 10, with the difference that now the punches 8 press on to the outer side walls 112*a* and 112*b*, while the common center wall 112*d* absorbs the forces of the punches 8 from both sides.

By using a longer cap, it is also possible to combine more than two switching systems to form a multiple relay, it also being possible to accommodate switching systems having different functions, for example a polarity-reversal relay and a single relay, in a common housing. Depending on the most economical manufacturing method, it is possible here to accommodate individual base bodies 1 and/or a multiple base body for two or more switching systems in the common cap. This results in cost-effective mounting of such a multiple relay on a printed circuit board.

Figure 14:
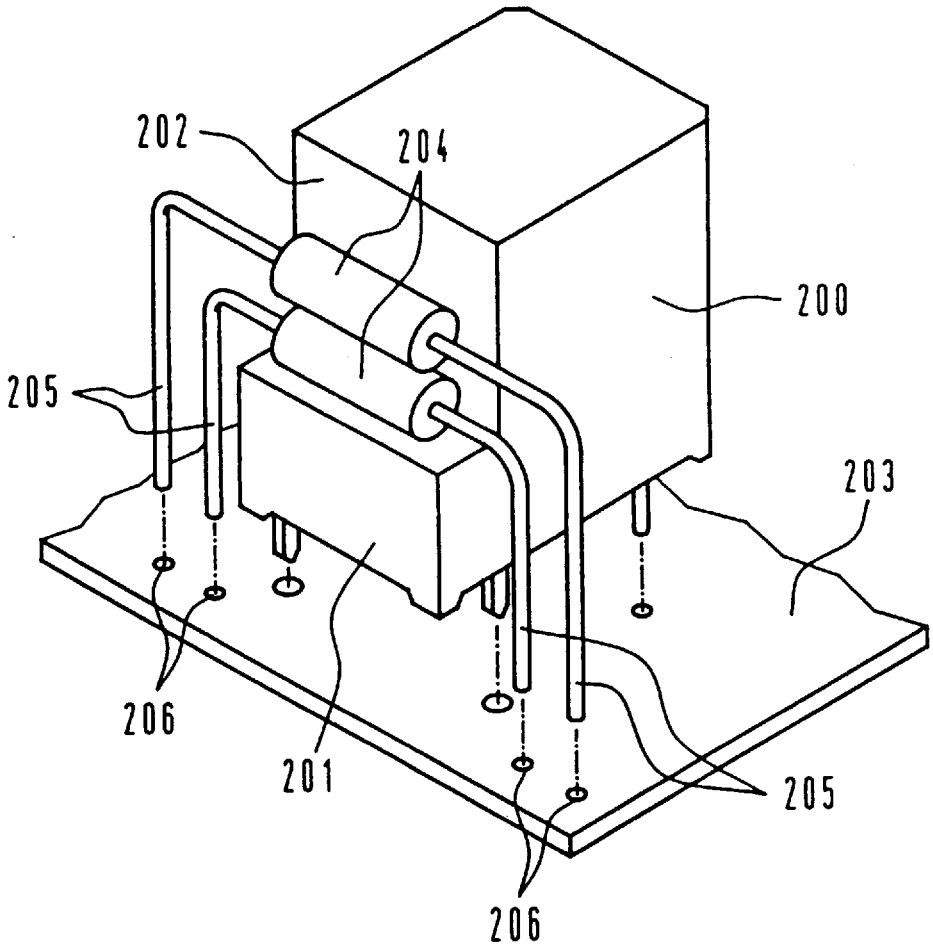
FIG. 14 shows a single relay with a stepped cap as it is being fitted into a printed circuit board together with other components.

As may be seen for example in FIG. 2 or FIG. 12, the contact-making parts of the contact spring 3 and the mating contact elements 5 and 6 are essentially arranged outside the region covered by the magnetic system 2. In this way, the space underneath the coil can be utilized entirely for a wide contact spring, but also for a pole plate 23*a* and an armature 26 having a large area. Thus, for example, a core having a round pole plate 23*a* is provided, this core being easier to produce and to mount than a core having a pole plate which is cut on one side. The free space above the contact-making parts can be utilized, for example in a cap 10 according to FIG. 7 or in a cap 100 according to FIG. 11, for accommodating additional components, such as resistors, diodes or a control IC, inside the relay housing. Alternatively, it is possible to design a cap such that it is stepped in a manner matching the form of the relay construction, as is shown for example in FIG. 14 with the cap 200. In the region of the base part, said cap has a projecting attachment 201 over the contact elements, while the upper part 202, encompassing only the coil width or depth, is recessed in a stepped manner. In the event of fitting on a printed circuit board 203, the free space above the projecting part 201 can be utilized for accommodating other components 204 whose connecting wires 205 are then soldered next to the relay in corresponding holes 206 in the printed circuit board.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. An electromagnetic relay having at least one switching system, comprising:

a base body forming a baseplate, a contact spring connection element and at least one mating contact element, each of which are anchored in the base body;

a coil having a core and a yoke, the coil being arranged upright with a winding axis thereof vertical to the baseplate;

an armature arranged between the coil and the baseplate; and a contact spring which is connected to the armature and interacts with the at least one mating contact element;

the contact spring forming first and second spring limbs, which are connected to one another in a U-shaped configuration in a region of an armature bearing of the armature and whose ends lie approximately next to one another in a vicinity of a movable armature end of the armature;

the first spring limb connected as a restoring limb to the contact spring connection element, and the second spring limb connected as a contact limb to the armature, the second spring limb having free end with the at least one mating contact element.

2. The relay as claimed in claim 1, wherein the contact spring, with the first and second spring limbs, covers approximately an entire area underneath the armature, wherein ends of the spring limbs project over the movable armature end, and wherein the contact spring connection element and the at least one mating contact element are anchored in the base body in a region in front of the movable armature end and are mutually oppositely angled in a direction of the free ends of the spring limbs.

3. The relay as claimed in claim 1, wherein the first and second spring limbs of the contact spring are formed by a U-shaped cut from a sheet-metal plane.

4. The relay as claimed in claim 1, wherein the first and second spring ends of the contact spring are formed by U-shaped folding through approximately 180° about an axis parallel to the armature axis, each of the spring ends being mutually oppositely cut free to approximately half the total spring width.

5. The relay as claimed in claim 1, wherein the base body is configured as a trough in a region of the baseplate, the trough having peripheral side walls with vertical insertion shafts, at least the contact spring connection element and a make-contact mating contact element being fastened in the vertical insertion shafts of the side walls.

6. The relay as claimed in claim 1, wherein the base body has a retention part with a U-shaped cross section, the retention part being oriented perpendicularly to the baseplate and, with grooves in side walls thereof, has a guiding shaft, which is perpendicular to the baseplate, for receiving a yoke limb of the yoke.

7. The relay as claimed in claim 1, wherein the contact spring connection element and the at least one mating contact element are anchored substantially outside a space covered by the coil in the base body, and wherein the core has a pole plate on an end of the core facing the armature, a diameter of the pole plate being greater than an internal diameter of the coil.

8. The relay as claimed in claim 1, wherein a cap is seated on the base body and has space for additional components over the contact spring connection element and the at least one mating contact element.

9. The relay as claimed in claim 1, wherein a cap is seated on the base body and is recessed to a depth corresponding to a coil diameter of the coil above the contact spring connection element and the at least one mating contact element.

10. The relay as claimed in claim 9, wherein the relay is attached to a printed circuit board, and wherein a space above the contact spring connection element and the at least one mating contact element, which is free by virtue of the cap, is used for arrangement of components whose connecting wires are made contact with next to the relay on the printed circuit board.

11. The relay as claimed in claim 1, wherein at least two switching systems are arranged next to one another in a common cap on the base body, armatures lying next to one another in a common plane.

12. The relay as claimed in claim 11, wherein at least the two switching systems are arranged in a common base body, second yoke limbs thereof lying in two guiding shafts, which lie next to one another in a common plane and are bounded by side walls on the base body and a common center wall of the base body.

13. The relay as claimed in claim 10, wherein the relay is attached to a printed circuit board and wherein a space above the contact spring connection element and the at least one mating contact element, which is free by virtue of the cap, is used for arrangement of components whose connecting wires are made contact with next to the relay on the printed circuit board.

* * * * *